United States Patent [19]

Massin

[11] 4,158,939

[45] Jun. 26, 1979

[54] LINING SLABS

[75] Inventor: Daniel M. Massin, Donchery, France

[73] Assignee: Foseco Trading AG

[21] Appl. No.: 819,344

[22] Filed: Jul. 27, 1977

Related U.S. Application Data

[62] Division of Ser. No. 735,214, Oct. 22, 1976, Pat. No. 4,055,336.

[30] Foreign Application Priority Data

Nov. 10, 1975 [GB] United Kingdom ..... 46434/75

[51] Int. Cl.[2] ..... E04C 1/10

[52] U.S. Cl. ..... 52/593; 52/392; 52/590; 52/594

[58] Field of Search ..... 52/590, 591, 594, 593, 52/392, 284, 286

[56] References Cited

U.S. PATENT DOCUMENTS

| | | | |
|---|---|---|---|
| 282,483 | 8/1883 | Baker | 52/286 X |
| 452,412 | 5/1891 | Meyer | 404/41 |
| 1,338,509 | 4/1920 | Johnson | 52/590 V |
| 1,360,245 | 11/1920 | Straight | 52/593 X |
| 1,500,738 | 7/1924 | Howard et al. | 264/146 |
| 1,655,383 | 1/1928 | Bean | 52/594 |
| 1,921,107 | 8/1933 | Todd | 52/593 X |
| 3,056,362 | 10/1962 | Hosbein et al. | 52/485 X |
| 3,394,521 | 7/1968 | Coleman | 52/249 X |
| 3,740,909 | 6/1973 | Stinnes | 52/595 X |

FOREIGN PATENT DOCUMENTS

| | | | |
|---|---|---|---|
| 565750 | 3/1958 | Belgium | 52/590 |
| 2164503 | 7/1973 | Fed. Rep. of Germany | 52/590 |
| 52139 | 3/1942 | Netherlands | 52/593 |
| 8939 of | 1841 | United Kingdom | 404/41 |
| 24469 of | 1912 | United Kingdom. | |
| 571856 | 9/1945 | United Kingdom | 52/590 |
| 729062 | 5/1955 | United Kingdom. | |
| 1294377 | 10/1972 | United Kingdom. | |

*Primary Examiner*—Alfred C. Perham

*Attorney, Agent, or Firm*—Cushman, Darby & Cushman

[57] ABSTRACT

A substantially planar slab has two opposite edges castellated in such fashion that two such slabs may be interengaged with the slabs in the same plane with the castellations of one edge of one slab interfitting the castellations on the other edge of the other slab. The sides of the castellations are inclined in a direction not normal to the plane of a major face of the slab. Such slabs are useful for lining containers for molten metal, and when forming such a lining all joint faces of the interengaging castellations not lying in vertical planes can be arranged to slope downwardly away from the interior of the molten metal container. The thickness of the slabs, the angle of the castellations, the period of the castellations and the inclination of the slabs can be so chosen relative to the angle of repose of a loose fill of refractory material under the slabs that the loose fill particulate refractory material does not penetrate the joints between adjacent slabs.

6 Claims, 4 Drawing Figures

2
5
9
6
5

LINING SLABS

This is a division, of application Ser. No. 735,214 filed Oct. 22, 1976, (now U.S. Pat. No.) 4,055,336.

This invention relates to slabs for use in lining containers, particularly to lining slabs formed of refractory heat insulating material used to line molten metal containers in the metallurgical industry.

One particular area of application of the present invention of considerable value is in the lining of tundishes. Tundishes are vessels used in continuous casting to provide a constant head of molten metal to feed into a continuous casting mould. During the process of continuous casting, metal is fed to a tundish e.g. from one or more ladles and is allowed to flow from the base of the tundish via one or more nozzles into one or more casting moulds. Tundishes are usually constructed of an outer metal casing lined with a relatively permanent refractory lining, which may either be made up of bricks or may be a monolithic lining of refractory concrete cast in situ.

In recent years, a practice has grown up of protecting that relatively permanent refractory lining with an inner lining of an expendable nature, i.e. after each casting cycle, the inner lining is removed and discarded, a fresh inner lining being installed prior to the commencement of the next casting cycle. Such inner linings which are described in British Patent Specification No. 1364665 are generally made up of a set of slabs of refractory heat insulating material. German Offenlegungsschrift No. 2435895 describes a tundish having a relatively permanent lining and an expendable lining made up of a set of slabs of refractory heat insulating material and having a layer of loose particulate material such as silica sand between the expendable and permanent linings. The layer of loose particulate material has a number of advantages: in particular, if molten metal penetrates the joints between the slabs forming the expendable lining, the particulate material prevents damage to the relatively permanent lining. In addition, the layer of particulate material, usually sand, provides a bedding layer for the slabs of the expendable lining so that they are evenly supported and the incidence of cracking under the effect of the metallostatic pressure when the tundish is filled is substantially reduced or eliminated entirely. The intermediate loose particulate layer also improves the thermal insulation around the molten metal.

In both these cases, i.e. with or without the layer of loose particulate material, it is customary to seal the joints between adjacent slabs of the expendable lining using a refractory mortar or cement. This sealing assists in preventing molten metal penetrating the joints and coming into contact with the relatively permanent lining and, where a loose fill of particulate refractory material is used, prevent that material entering the cavity of the tundish which in use is to be filled with molten metal.

The application of refractory mortar or cement to joints is time-consuming and requires skill on the part of the persons lining the tundish. In addition to the actual operating time required to set the slabs, many refractory mortars or cements require to be dried before the tundish can be put to use. Tundishes are expensive and constraints of this nature are accordingly very uneconomic.

Within the metallurgical industry and in other industries such as the construction and packaging industries analogous situations arise in which linings are backed by loose fill material. Analogous difficulties arise from penetration of the loose fill through the joints necessitating the adoption of measures such as sealing compounds, cements or gaskets, all of which are complex, expensive and time-consuming to apply.

According to a first feature of the present invention there is provided a substantially planar slab having two opposite edges castellated in such a fashion that two such slabs may be interengaged with the slabs in the same plane with the castellations of one edge of one slab interfitting the castellations on the other edge of the other slab, and wherein the sides of the castellations are inclined in a direction not normal to the plane of a major face of the slab.

Preferably the position of the castellations on the castellated edges is such that two identical slabs may be interengaged side by side with their non-castellated edges aligned with one another. Preferably the inclination and dimensions of the castellations are such that when two slabs are interengaged side by side, any line normal to the plane of a major face of the slab passes through the material of at least one of the slabs.

The castellations may vary widely in their configuration, and may have generally flat, curved or faceted faces. Simple geometry is preferred for the castellations, however, to facilitate manufacture of the slabs. Thus, preferably the base and top of each castellation is a parallelogram lying in a plane normal to the plane of a major face of the slab. The sides of the castellations, which are preferably in parallel planes, will generally in such a case be rectangular.

According to a particular preferred feature of the present invention there is provided a container for molten metal having a floor and sidewalls and having an inner wall lining made up of a plurality of slabs of refractory heat insulating material, at least some of the slabs having two opposite edges castellated with interengaging castellations forming the joints between the slabs, wherein all joint faces of the castellations not lying in vertical planes slope downwardly away from the interior of the molten metal container.

In a particularly preferred form, the slabs are used to constitute an inner lining for a tundish and are superimposed on a layer of loose fill refractory material. In such circumstances, the wall lining slabs are generally arranged inclined outwardly upwardly. The arrangement should be one in which the thickness of the slabs, the angle of the castellations, the period of the castellations and the inclination of the slabs are so chosen relative to the angle of repose of the loose fill refractory material, usually sand, between the slabs and the relatively permanent lining that the loose fill particulate refractory material does not penetrate the joints.

In order to ensure that no leakage of particulate material through the joint can occur, it is preferable that a line drawn from the lower edge of one castellation adjacent the loose fill to the upper edge of the next castellation of the same slab adjacent the interior of the tundish rises at an angle of about 15° to the horizontal.

Slabs of the present invention may be made of any convenient material. When used for lining tundishes and other metallurgical vessels they are conveniently and preferably made of materials of the type disclosed in the British Patent Specification and German Offenlegungsschrift referred to above.

It is found that slabs according to the present invention can be assembled easily and quickly to line areas and that great care does not have to be exercised when assembling the joints. An exact and tight fit is not necessary in order to give a joint resistant to penetration by loose particulate material.

It will be appreciated that in lining any particular container or cavity, only some of the lining slabs need be as defined above and indeed it will often be advantageous for specific purposes to provide lining slabs for use in conjunction with slabs according to the present invention which are not so castellated, though those additional lining slabs may have one or more edges bearing some form of castellation for interengagement with slabs according to the present invention.

The invention is illustrated by way of Example with reference to the specific case of the lining of a tundish for use in continuous casting, and with reference to the accompanying drawings.

Figure 1:
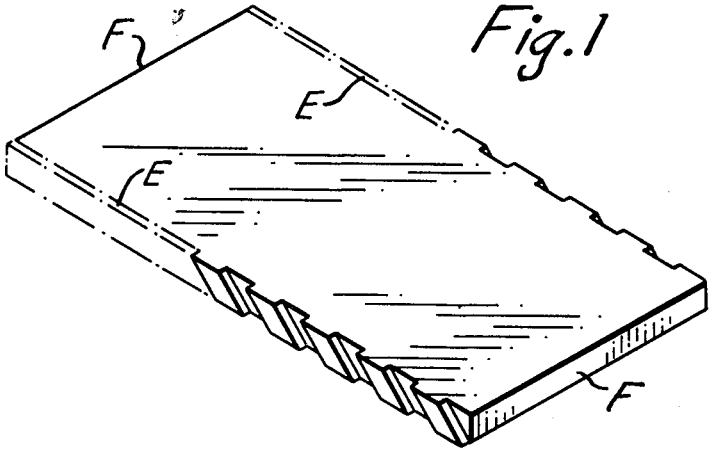
FIG. 1 is a perspective view of a slab according to the present invention.
Figure 2:
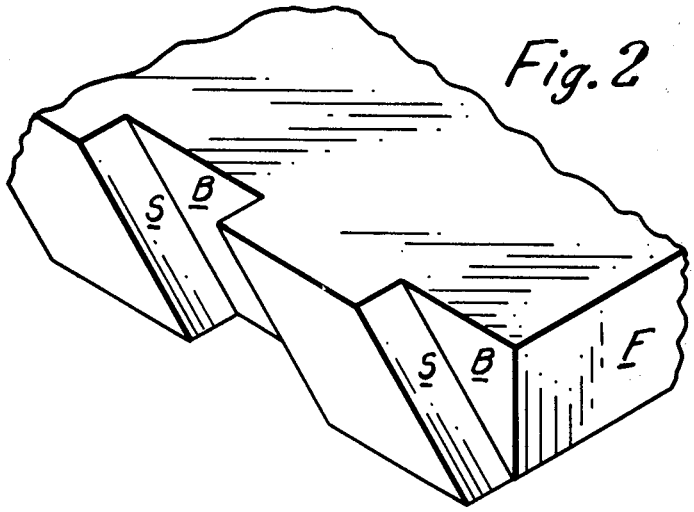
FIG. 2 is a perspective view on an enlarged scale of one corner of the slab of FIG. 1.

Referring first to FIGS. 1 and 2, a lining slab according to the present invention as illustrated is a substantially rectangular slab having two opposite edges E castellated and two plane edges F. The sides of the castellations S do not run normal to the major plane of the slab but run at an angle thereto, preferably at an angle of about 45°. It will be seen that the base B of each castellation on one side of the slab corresponds to the protruding part of the castellation on the other side of the slab. Thus a plurality of slabs as shown in FIG. 1 may be fitted together side by side with their uncastellated edges F in line.

Figure 3:
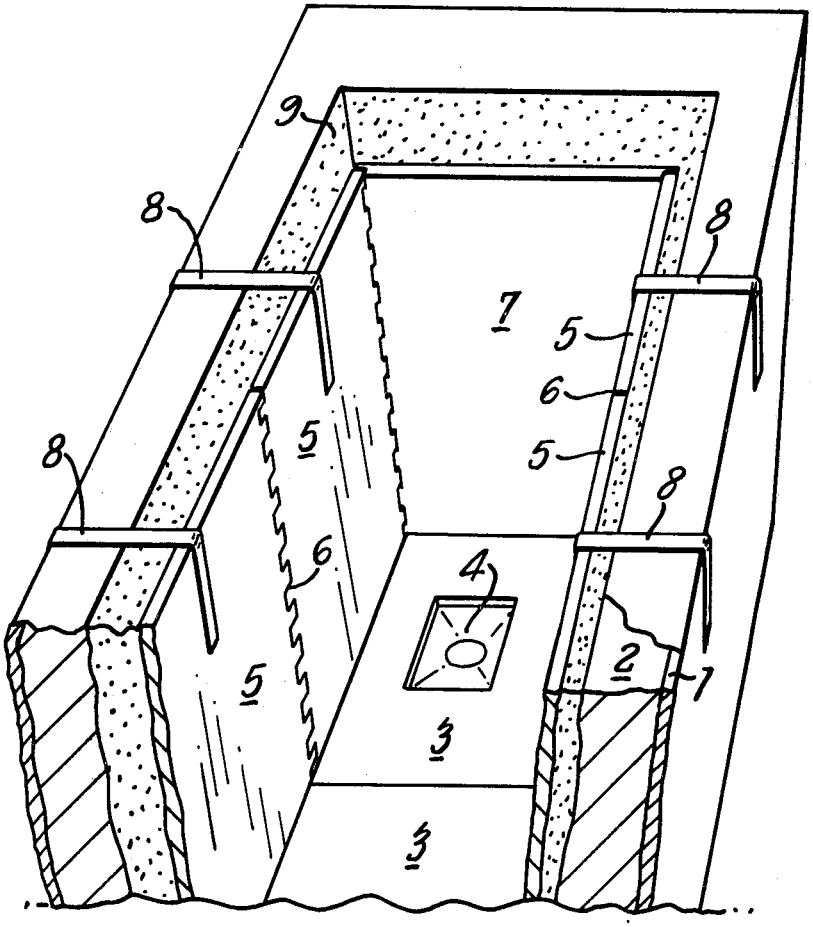
FIG. 3 is a perspective view of one end of a lined tundish.
Figure 4:
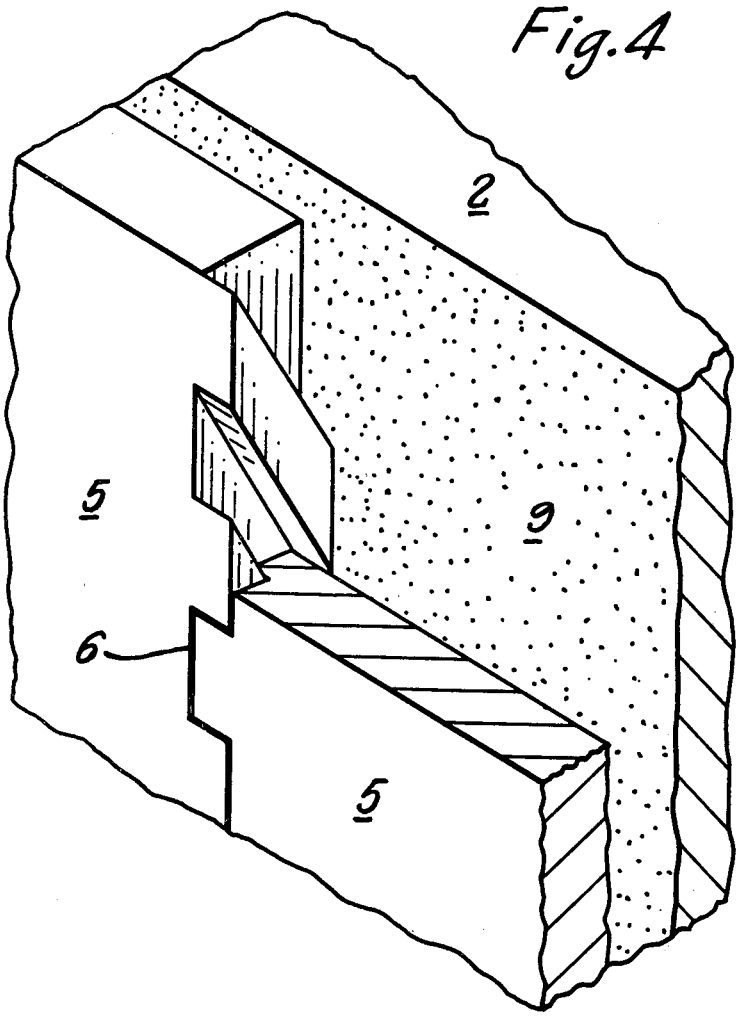
FIG. 4 is a perspective view, part broken away, of a joint between two lining slabs.

Referring now to FIGS. 3 and 4, these show part of a tundish used in the continuous casting of molten metal.

The tundish consists of an outer metal casing 1 which is provided with a relatively permanent refractory lining 2 either made of refractory brick or of refractory concrete cast in situ to define an inner cavity having flat walls and base.

In order to protect this relatively permanent lining in use, the interior of the tundish is lined with expendable lining slabs. First a plurality of lining slabs 3 is set on the floor of the tundish. These slabs are generally rectangular and some of them have apertures which correspond to nozzle outlets 4 in the base of the tundish. These slabs may be abutted together or interengaged by means of castellations.

After the floor has been lined with slabs 3, the walls are lined using slabs 5 according to the present invention. Slabs 5 are assembled together with interengagement of the castellations at their edges to form joints 6. Conveniently, the tundish is lined with slabs 5 starting from the middle and working outwards along each wall towards the ends of the tundish. Slabs 5 are inclined outwardly and upwardly. At the ends, generally trapezoid lining slabs 7 are inserted into position. The edges of slabs 7 bear indentations corresponding to the castellations on the edge of a slab 5. Slabs 5 and slabs 7 are held in position and spaced from the relatively permanent lining 2 by means of pieces of scrap refractory lining slab or refractory brick. In addition, slabs 5 are restrained from moving too far away from the relatively permanent lining 2 by means of a number of metal clips 8 which simply clip over the top edge of the tundish as shown. After the slabs 5 and 7 and the clips 8 have all been put into position, the gap between the relatively permanent lining 2 and the slabs 5 and 7 is filled with a loose fill 9 of sand, usually with the aid of an appropriate sand filling apparatus such as one in which a fluidised stream of sand may be released from a hand held nozzle on the end of a flexible pipe. Because of the construction of joints 6 given by the castellated edges of slabs 5, most clearly visible in FIG. 4, the loose fill of sand 9 does not pass through joints 6 and into the interior of the tundish. Even if slabs 5 are not particularly tightly butted together, the slope of the castellations, their inclination, their relative spacing and the thickness of the slab ensure that the sand 9 does not penetrate to the interior of the tundish.

The lower end face of each slab 5 may be flat as the faces F in FIG. 1 but it is preferably shaped e.g. rounded so as to engage a correspondingly shaped groove or depression running along the side of floor lining slab 3.

What is claimed is:

1. A slab having two substantially planar substantially parallel quadrate major faces, and having two opposite regularly castellated edges, and two opposite planar edges extending between said castellated edges, the thickness of the slab being small relative to the length of said castellated or planar edges;

said castellated edges including a plurality of teeth with slots defined between the teeth, said slots extending from one major face to the other, each said tooth having a base and a top, and having a pair of opposite sides that are not disposed in the plane of said major faces, the top of each tooth being substantially of the same dimension as each slot between the teeth; said teeth sides being inclined in a direction skew to the plane of a major face of the slab and inclined such that any line normal to the plane of a major face of the slab at any castellated edge portion thereof passes through the material of the slab; and said castellated edges being so arranged that two identical slabs may be interengaged side by side with their respective major faces disposed in the same planes and their planar edges in line by relative movement in a plane parallel to said major faces.

2. A slab according to claim 1 wherein the sides of each of the castellation teeth are planar and lie in parallel planes.

3. A slab according to claim 1 wherein the base and top of each castellation tooth is a non-rectangular parallelogram lying in a plane normal to the plane of a major face of the slab.

4. A slab according to claim 1 wherein the sides of each of the castellation teeth are rectangular and lie in parallel planes.

5. A slab according to claim 1 wherein the inclination of each of the castellation teeth to the major plane of the slab is about 45°.

6. A slab having two substantially planar substantially parallel major faces, and having two opposite regularly castellated edges, the edges having a length that is large relative to the slab thickness, said castellated edges including a plurality of teeth with slots defined between the teeth, said slots extending from one major face to the other, each said tooth having a base and a top, and having a pair of opposite sides that are not disposed in the plane of said major faces, the top of each tooth being substantially of the same dimension as each slot between the teeth; said teeth sides being inclined in a direction skew to the plane of a major face of the slab;

and the inclination, dimensions, and spacing of each of the castellation teeth being such that any line normal to the plane of a major face of the slab at any castellated edge portion thereof passes through the material of the slab; and said castellated edges being so arranged that two identical slabs may be interengaged side by side with their respective major faces disposed in the same planes by relative movement in a plane parallel to said major faces.

* * * * *